United States Patent [19]

Gruber et al.

[11] 4,350,302

[45] Sep. 21, 1982

[54] LIQUID SPRAY NOZZLE

[75] Inventors: Martin V. Gruber; Mahendra F. Doshi, both of Tampa, Fla.

[73] Assignee: Zurn Industries, Inc., Erie, Pa.

[21] Appl. No.: 188,627

[22] Filed: Sep. 19, 1980

[51] Int. Cl.[3] ..... B05B 1/26

[52] U.S. Cl. ..... 239/500; 239/504; 239/600; 285/DIG. 22

[58] Field of Search ..... 239/500, 504, 505, 518, 239/524, 600; 285/DIG. 22

[56] References Cited

U.S. PATENT DOCUMENTS

| | | | |
|---|---|---|---|
| 716,635 | 12/1902 | Haycraft | 239/518 |
| 1,153,805 | 9/1915 | MacDonald | 239/500 X |
| 1,877,046 | 9/1932 | Phillips . | |
| 2,135,138 | 11/1938 | Kendall | 239/500 X |
| 2,375,528 | 5/1945 | DeFlon | 299/121 |
| 3,061,204 | 10/1962 | MacInnes et al. | 239/500 |
| 3,178,119 | 4/1965 | Thorson | 239/524 X |
| 3,617,036 | 11/1971 | Brown | 261/111 |
| 4,094,937 | 6/1978 | Bodick et al. | 261/111 |
| 4,099,675 | 7/1978 | Wohler et al. | 239/498 |
| 4,111,366 | 9/1978 | DeWitte | 239/222 |
| 4,128,264 | 12/1978 | Oldford | 285/DIG. 22 X |

FOREIGN PATENT DOCUMENTS

| | | | |
|---|---|---|---|
| 631950 | 6/1936 | Fed. Rep. of Germany | 239/504 |
| 1369539 | 6/1964 | France | 239/600 |

*Primary Examiner*—Andres Kashnikow

*Attorney, Agent, or Firm*—Webb, Burden, Robinson & Webb

[57] ABSTRACT

A liquid spray nozzle including a body portion having a throat with a discharge orifice and first, second and third splash plates mounted in series below and coaxial with the orifice. The first and second splash plates having an axial opening formed therein and the third splash plate having a conical portion coaxial with the axial openings. Each of the first, second and third splash plates having a plurality of slots extending therethrough.

6 Claims, 7 Drawing Figures

LIQUID SPRAY NOZZLE

Our invention relates generally to a nozzle for use in water cooling towers and more particularly to a spray nozzle which is connected to a hot water distribution pipe located in the upper portion of a cooling tower to evenly distribute hot water over the fill assembly in the cooling tower.

In a conventional water cooling tower of the forced or induced draft type, a hot water distribution system is provided overlying an air liquid contact fill assembly which is located above a cold water collection basin. Hot water passes through distribution pipes and gravitates therefrom through apertures in the bottom portion of the hot water distribution pipes. It is known to utilize a removable nozzle in each hot water distribution pipe aperture. The nozzles are fabricated from a corrosion resistant material and are provided with a central cylindrical body portion extending downwardly from the aperture in the distribution pipe. It is advantageous to use removable nozzles as the water loading and the size of the fill assembly can be varied as desired by using nozzles with different size water discharge orifices.

The stream of hot water discharged from many prior art nozzles was in the form of a relatively compact column of liquid falling downwardly toward the fill assembly. It is desirable to break up the stream of hot water gravitating from the distribution pipe to obtain more uniform distribution of the hot water over that portion of the upper face of the fill assembly below each nozzle. In order to break up a stream of water, it is desirable to provide baffles or diffusion plates underlying the nozzle discharging orifice as disclosed in U.S. Pat. Nos. 4,099,675; 3,061,204; 2,375,528 and 1,877,046. A plurality of baffles may be located below the nozzle discharge orifice and various configurations and sizes have been used. While baffles of various sizes and configurations have performed with reasonable efficiency under various water loading conditions and operating parameters, the use of baffles has presented problems from the standpoint of installation and uniformity of water distribution.

Our novel nozzle provides integrated water stream control and diffusion. The nozzle of our invention may be easily and rapidly inserted into and removed from an aperture in the lower portion of a hot water distribution pipe. The nozzle and baffle arrangement of our invention are uniquely constructed to break up the column of water discharged from the orifice of the nozzle into a spray pattern which assures uniform distribution of water over that section of the fill supplied by the nozzle to permit complete contact of the water droplets by air rising through the fill. Our nozzle is fabricated as a substantially unitary assembly for easy handling and inexpensive manufacture.

An example of a mechanical cooling tower wherein our nozzle may be used is disclosed in U.S. Pat. No. 4,094,937 which is owned by the assignee of the present invention. Our nozzle may also be used in natural draft cooling towers.

In the operation of a cooling tower, the hot water flows down through the fill in contact with upwardly flowing air, and some of the water evaporates which cools the remaining water as it flows downwardly to the basin at the base of the tower. Cooling tower dimensions are substantial, and it is important to have the hot water pass through a large mass of fill material to insure that the water is sufficiently cooled. Our nozzle causes a more even distribution of water over the entire fill material at a much lower head pressure than prior art nozzles which use internal vanes. Additionally, the design of our nozzle permits it to be attached to a hot water distribution pipe for easy and rapid insertion and removal. This effects a substantial savings in time and expense when the nozzles are initially installed and when it is necessary to replace nozzles. Prior art nozzles are usually attached to a distribution pipe by a threaded connection having a collar within or affixed to the pipe. It is both time consuming and difficult to install a nozzle using this arrangement. Additionally, our nozzle has a larger throat and discharge orifice than prior art nozzles which means that it is less likely to clog than prior art nozzles which require a smaller discharge opening and/or vanes to increase the velocity of the hot water flowing through the nozzle at the same flow rate as utilized in our nozzle.

Our invention is described hereinafter with reference to the drawings wherein.

Figure 1:
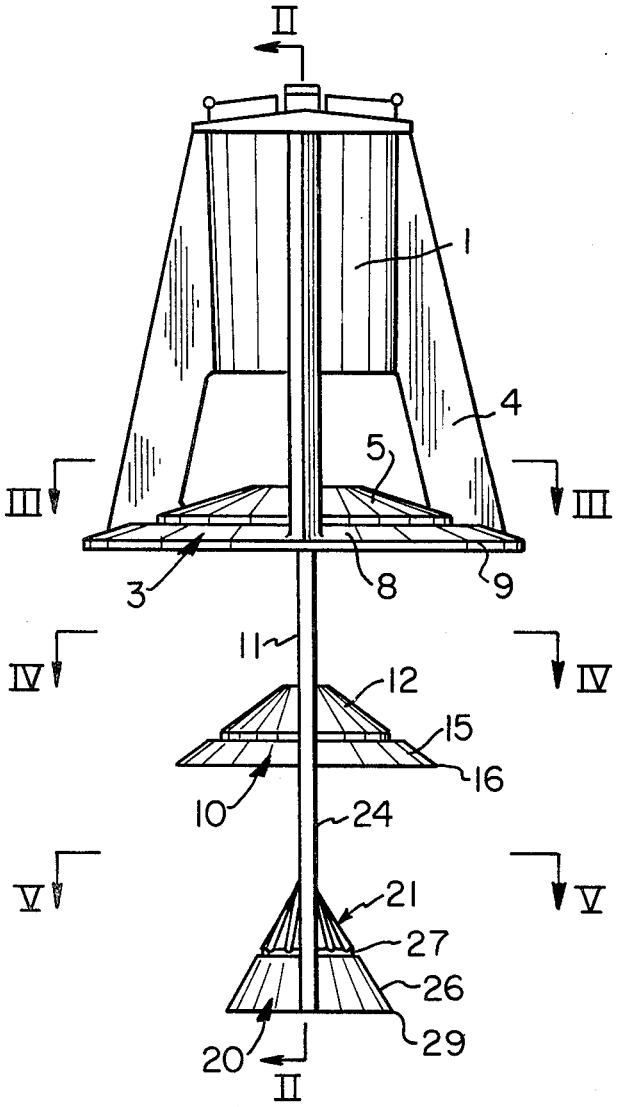
FIG. 1 is an elevation of our nozzle.

With reference to FIGS. 1-5 of the drawings, the nozzle consists of a body portion 1 having a throat 2 with a discharge orifice at its lower end and three splash plates located below and coaxial with the orifice. The first splash plate 3 is attached to body portion 1 by four ribs 4 angularly spaced 90 degrees. Splash plate 3 has a central portion 5 with an axial opening 6 and four arcuate slots 7 located between the central portion and a rim 8. Each arcuate slot extends between adjacent ribs 4 and covers slightly less than 90 degrees of the splash plate circumference. The circumferential edge 9 of the rim of splash plate 3 is located radially outwardly of slots 7 and is substantially vertical.

A second splash plate 10 is spaced below and coaxial with splash plate 3. Splash plate 10 is connected with splash plate 3 by two ribs 11 angularly spaced 180 degrees. Splash plate 10 has a central portion 12 with an axial opening 13 and two arcuate slots 14 located between the central portion and a rim portion 15. The circumferential edge 16 of rim portion 15 is located outwardly of slots 14 and has a sharp edge.

Figure 2:
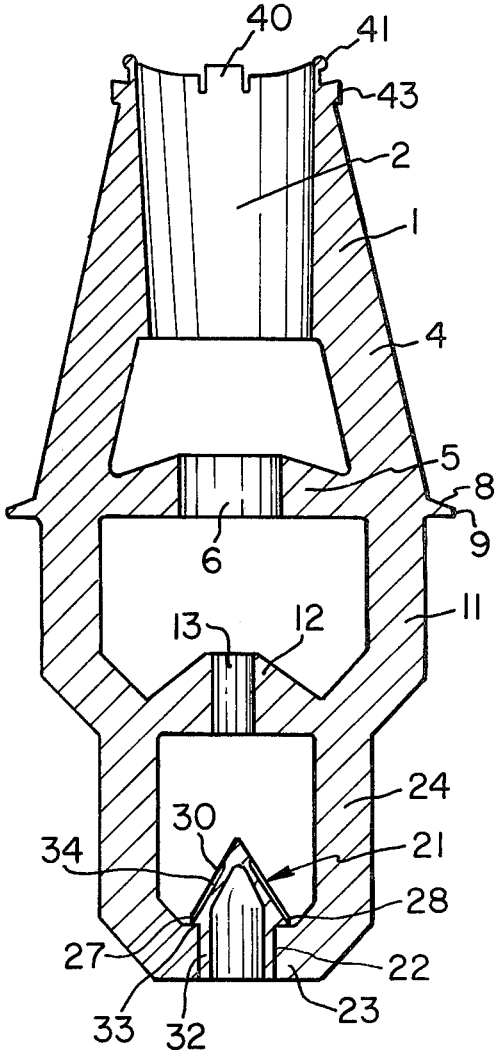
FIG. 2 is a section on line II—II of FIG. 1.
Figure 3:
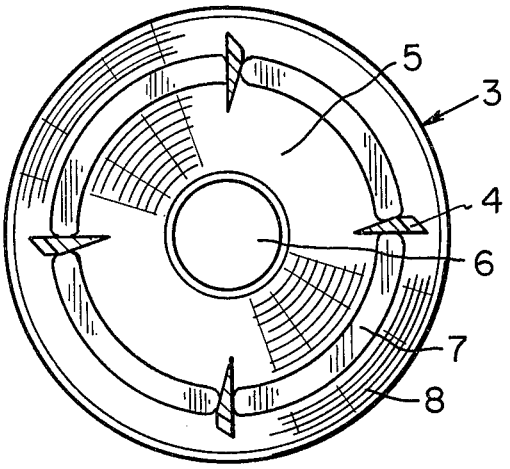
FIG. 3 is a section on line III—III of FIG. 1.
Figure 4:
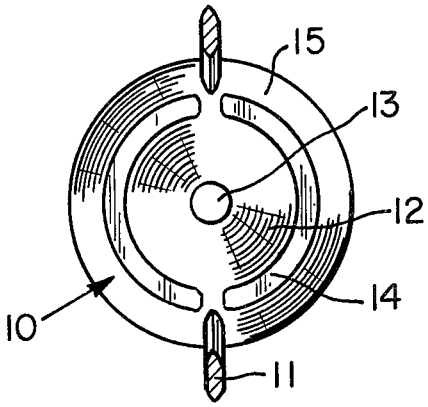
FIG. 4 is a section on line IV—IV of FIG. 1.
Figure 5:
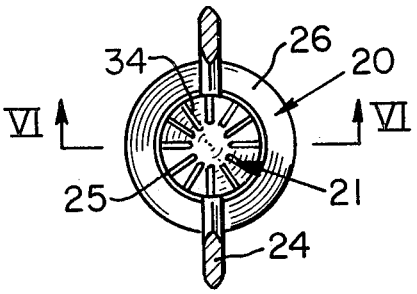
FIG. 5 is a section on line V—V of FIG. 1.
Figure 6:
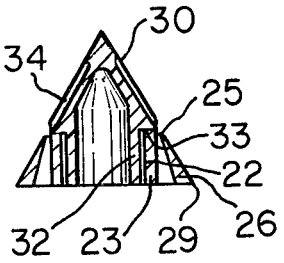
FIG. 6 is a section on line VI—VI of FIG. 5.

A third splash plate 20 is spaced below and coaxial with splash plates 3 and 10. Splash plate 20 consists of an insert 21 which fits into a central opening 22 in an annular portion 23 which is supported from splash plate 10 by two ribs 24 which are continuations of ribs 11. Two arcuate slots 25 are formed in splash plate 20 between ribs 24. Arcuate slots 25 are located between annular portion 23 and a rim portion 26. As shown in FIGS. 2, 5 and 6, the inner radius of slots 25 is defined by edge 27 of insert 21 which has a substantially vertical cylindrical wall 28. The circumferential edge 29 of rim portion 26 is located outwardly of slots 25 and has a sharp edge. Insert 21 fits into central opening 22 in splash plate 20 and has a conical portion 30 which terminates in a wall 28. Conical portion 30 is formed with a plurality of equally spaced radial slots 34 which are spaced at approximately 30 degrees around conical portion 30. Insert 21 also has a cylindrical shank 32 extending downwardly from the conical portion into central opening 22 in annular portion 23. A lip 33 on insert 21 supports insert 21 on annular portion 23 of splash plate 20. The nozzle is molded as a single unit with the exception of insert 21 in splash plate 20.

While we have shown three splash plates below the nozzle discharge orifice, it will be understood by those skilled in the art that more than three splash plates may be used under certain conditions of operation.

Figure 7:
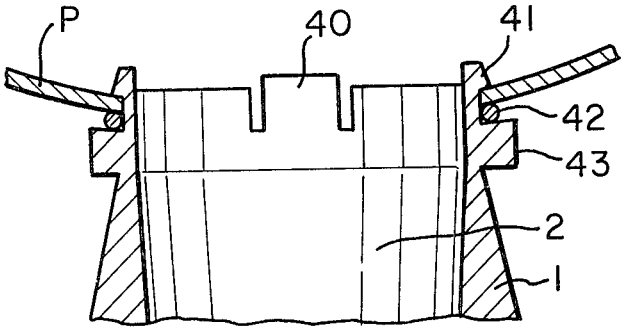
FIG. 7 is a partial vertical section through a nozzle attached to a distribution pipe.

As will be seen in FIG. 7 of the drawings, the nozzle of our invention has four tabs 40 at the upper end of body portion 1 which are formed with outwardly extending ears 41. Because the nozzle is made of a plastic material, tabs 40 are sufficiently resilient to permit them to be snapped into an opening in a hot water distribution pipe P so that ears 41 overhang the periphery of the opening in the pipe and contact the inside surface of the pipe. A resilient O-ring 42 surrounds the exterior of body portion 1 and is located between a flange 43 on the exterior of the body portion and the exterior surface of pipe P. The O-ring is made of a resilient material so that it will firmly seat the body portion of the nozzle against the exterior surface of pipe P and prevent it from wobbling on the pipe.

In operation we have found that about 60% of the water passing through the discharge orifice of throat 2 of the nozzle flows radially along the surface of splash plate 3 and passes through slots 7 and over vertical edge 9, and approximately 40% of the water passes through axial opening 6 to contact splash plate 10. Approximately 7% of the water which contacts splash plate 10 passes through axial opening 13 to contact splash plate 20 where it is directed by conical portion 30 to slots 25 and 34 and to edge 29. The surface tension between the water and surfaces of the splash plates and the low water velocity cause a portion of the water to fall through the slots in each splash plate and a portion of the water to pass over the outer circumferential edge of each splash plate.

Our nozzle is substantially more efficient than those disclosed in the aforementioned prior art patents and in U.S. Pat. Nos. 4,111,366 and 3,617,036 since it distributes the hot water uniformly over a greater area of fill. It is desirable to avoid the formation of "dead spots" which do not receive any falling droplets of hot water, and by utilizing our novel nozzle, contact of the fill area is maximized since dead spots are substantially eliminated and the hot water is evenly distributed over a much greater area. This makes it possible to eliminate approximately one-half the nozzles having designs according to the prior art.

The use of fewer nozzles to distribute the same quantity of water means that the individual nozzle discharge orifices are larger than in prior art nozzles. Therefore, there is less possibility of nozzles clogging than in prior art nozzles having substantially smaller orifices. Additionally, the uniform distribution of hot water over the fill area when using our nozzles results in better water cooling than with prior art nozzles. This result is achieved by utilizing three splash plates having central openings and slots in our nozzle.

Another substantial advantage of our nozzle is the way in which it is attached to the hot water distribution pipe. In the past threaded connectors have been used which means that the upper connector must be retained in position while the nozzle body portion is rotated to tighten the threads. With our snap-in arrangement the body portion of the nozzle is easily inserted into and removed from the distribution pipe in a minimum of time.

While we have described a preferred embodiment of our invention herein, it is to be understood that it may be embodied within the scope of the appended claims.

We claim:

1. A nozzle including a body portion having a throat with a discharge orifice, a first splash plate, means mounting said first splash plate below and coaxial with said discharge orifice, a second splash plate, means mounting said second splash plate below and coaxial with said first splash plate, a third splash plate, means mounting said third splash plate below and coaxial with said second splash plate, each of said first and second splash plates having an axial opening formed therein and said third splash plate including a conical portion coaxial with said axial openings, each of said first, second and third splash plates having a plurality of slots extending therethrough, said slots in said first and second splash plates being arcuate and parallel to the edge of the splash plate in which they are located, said arcuate slots being located radially outwardly of said axial opening in each of said first and second splash plates and extending substantially continuously around the complete circumference of the splash plate in which they are located, and means for mounting said nozzle on the exterior surface of a distribution pipe.

2. A nozzle as set forth in claim 1 wherein said first splash plate has at least four arcuate slots.

3. A nozzle as set forth in claim 1 wherein said second splash plate has two arcuate slots.

4. A nozzle as set forth in claim 1 wherein said third splash plate has radial slots and arcuate slots.

5. A nozzle as set forth in claim 4 wherein said radial slots are formed in said conical portion and said arcuate slots are radially outwardly of said conical portion.

6. A spray nozzle as set forth in claim 1 wherein said third splash plate includes an annular portion connected to said mounting means and having an axial opening formed therein and said conical portion is formed on an insert having a depending cylindrical shank located in said opening in said annular portion to support said insert on said annular portion.

* * * * *